US006279442B1

(12) United States Patent
Chang

(10) Patent No.: US 6,279,442 B1
(45) Date of Patent: Aug. 28, 2001

(54) BLADE GUARD DEVICE FOR A SAWING MACHINE

(76) Inventor: Chin-Chin Chang, No. 122, Lane 967, San Feng Road, Feng Yuan Taichung Hsien (TW)

( * ) Notice: Subject to any disclaimer, the term of this patent is extended or adjusted under 35 U.S.C. 154(b) by 0 days.

(21) Appl. No.: 09/558,360

(22) Filed: Apr. 26, 2000

Related U.S. Application Data

(63) Continuation-in-part of application No. 09/151,836, filed on Sep. 11, 1998.

(51) Int. Cl.[7] ..... B27B 5/18
(52) U.S. Cl. ..... 83/397; 83/478; 83/490
(58) Field of Search ..... 83/471.2, 397, 83/471.3, 468.3, 478, 490, 544

(56) References Cited

U.S. PATENT DOCUMENTS 3,998,121 * 12/1976 Bennett ..... 83/471.2
4,934,233 * 6/1990 Brundage et al. ..... 83/397
5,054,352 * 10/1991 Fushiya et al. ..... 83/468.3
5,203,245 * 4/1993 Terpstra ..... 83/397
5,257,570 * 11/1993 Shiotani et al. ..... 83/471.3
5,370,025 * 12/1994 Itzov ..... 83/397
5,609,085 * 3/1997 Chang ..... 83/397
5,724,875 * 3/1998 Meredith et al. ..... 83/397
5,752,421 * 5/1998 Chang ..... 83/397

* cited by examiner

*Primary Examiner*—M. Rachuba
*Assistant Examiner*—Omar Flores Sánchez
(74) *Attorney, Agent, or Firm*—Connolly Bove Lodge & Hutz LLP

(57) ABSTRACT

A blade guard device for a circular sawing machine includes an upper guard having a lower end pivotally mounted on a stationary base and an upper end including a handle, a circular saw rotatably mounted on the upper guard, an elongated pressing lever pivotally mounted on a locating plate and having a curved operation surface including a projection, an inclined section, and a lower bent section, a pressing roller secured on the upper guard and slidably engaging the curved operation surface of the pressing lever, a link secured to the pressing lever, a circular mounting plate secured to the link and rotatably mounted on the upper guard, and a lower guard secured to the circular mounting plate for covering the circular saw. In such a manner, when the handle is moved downward, the upper guard is pivoted downward to move the pressing roller to press the projection of the pressing lever, thereby moving the link which largely pulls the circular mounting plate for rapidly rotating the circular mounting plate which rapidly rotates the lower guard upward, thereby rapidly exposing a lower part of the circular saw.

2 Claims, 5 Drawing Sheets

BLADE GUARD DEVICE FOR A SAWING MACHINE

CROSS-REFERENCES TO RELATED APPLICATIONS

The present invention is a continuation-in-part application of the co-pending U.S. Ser. No. 09/151,836, filed on Sep. 11, 1998, now pending.

BACKGROUND OF THE INVENTION

1. Field of the Invention

The present invention relates to a blade guard device, and more particularly to blade guard device for a circular sawing machine.

2. Description of the Related Art

The closest prior art of which the applicant is aware was disclosed in U.S. Pat. No. 5,203,245 to Terpstra, filed on Oct. 19, 1992, entitled "SWINGING BLADE GUARD ASSEMBLY".

However, the blade guard assembly needs to additionally provide a slot 45 which co-operates with a slidable pin 47 for lifting a lower blade guard 25, thereby increasing the parts of the blade guard assembly, and increasing the cost of fabrication. In addition, the stiffness and rigidity of the blade guard assembly are weakened due to provision of the slot 45.

A conventional blade guard device for a circular sawing machine in accordance with the prior art shown in FIG. 1 comprises an upper guard 1, a lower guard 2, a Y-link 3, an elongated bent slot 4, a circular mounting plate 5, and a slide roller 6. In operation, the slide roller 6 is moved with the upper guard 1 to press the Y-link 3 which pulls and rotates the circular mounting plate 5 by the bent slot 4, thereby gradually rotating the lower guard 2 upward so that the circular sawing machine can be adapted to perform a safe sawing process. However, the gradual movement of the lower guard 2 makes the sawing process slow down, thereby greatly effecting the normal sawing operation of the circular sawing machine especially when it is used to saw a thick wood.

SUMMARY OF THE INVENTION

The present invention has arisen to mitigate and/or obviate the disadvantage of the conventional blade guard device for a circular sawing machine.

In accordance with one aspect of the present invention, there is provided a blade guard device for a circular sawing machine comprising: a support frame; a stationary base secured to the support frame; a locating plate secured to the stationary base; an upper guard having a lower end pivotally mounted on the stationary base and an upper end including a handle; a circular saw rotatably mounted on the upper guard; an elongated pressing lever having a first end pivotally mounted on the locating plate, and a mediate portion having a curved operation surface; a pressing roller secured on the upper guard to move therewith and slidably engaging the curved operation surface of the mediate portion of the pressing lever; a link having a first end secured to the second end of the pressing lever to move therewith; a circular mounting plate secured to a second end of the link to move therewith and rotatably mounted on the upper guard; and a lower guard secured to the circular mounting plate to rotate therewith for covering the circular saw.

The blade guard device further comprises a bolt extending through the second end of the pressing lever and through the first end of the link for securing the first end of the link to the second end of the pressing lever, and a bolt extending through the second end of the link and through the circular mounting plate for securing the second end of the link to the circular mounting plate.

The curved operation surface of the mediate portion of the pressing lever includes a projection extending outward and located proximate to the first end of the pressing lever, an inclined section extending inward from the projection, and a lower bent section extending from the inclined section and located proximate to the second end of the pressing lever.

By such an arrangement, when the handle is moved downward, the upper guard is pivoted downward to move the pressing roller which is initially moved to press the projection of the curved operation surface of the mediate portion of the pressing lever, thereby moving the link which largely pulls the circular mounting plate for rapidly rotating the circular mounting plate which rapidly rotates the lower guard upward, thereby rapidly exposing a lower part of the circular saw.

When the handle is further moved downward, the pressing roller is further moved to press the inclined section of the curved operation surface of the mediate portion of the pressing lever, thereby further moving the link which slightly pulls the circular mounting plate for gradually rotating the circular mounting plate which slowly rotates the lower guard upward, thereby slowly exposing the lower part of the circular saw.

When the handle is further moved downward, the pressing roller is further moved to press the lower bent section of the curved operation surface of the mediate portion of the pressing lever, thereby further moving the link which slightly pulls the circular mounting plate for gradually rotating the circular mounting plate which slowly rotates the lower guard upward, thereby slowly exposing the lower part of the circular saw.

Further benefits and advantages of the present invention will become apparent after a careful reading of the detailed description with appropriate reference to the accompanying drawings.

DETAILED DESCRIPTION OF THE INVENTION

Figure 1:
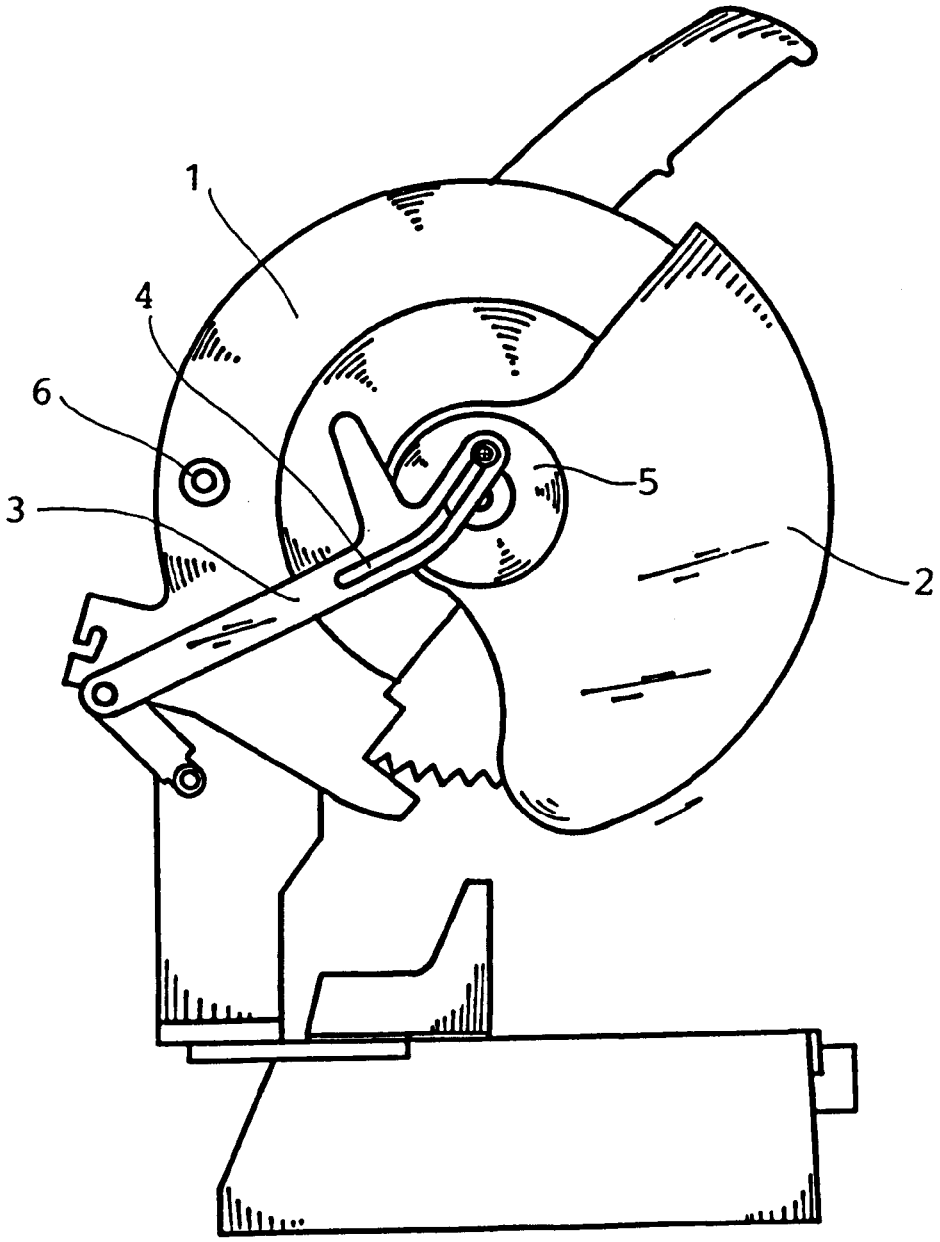
FIG. 1 ( PRIOR ART )
FIG. 1 is a side plan view of a conventional blade guard device for a circular sawing machine in accordance with the prior art.
Figure 2:
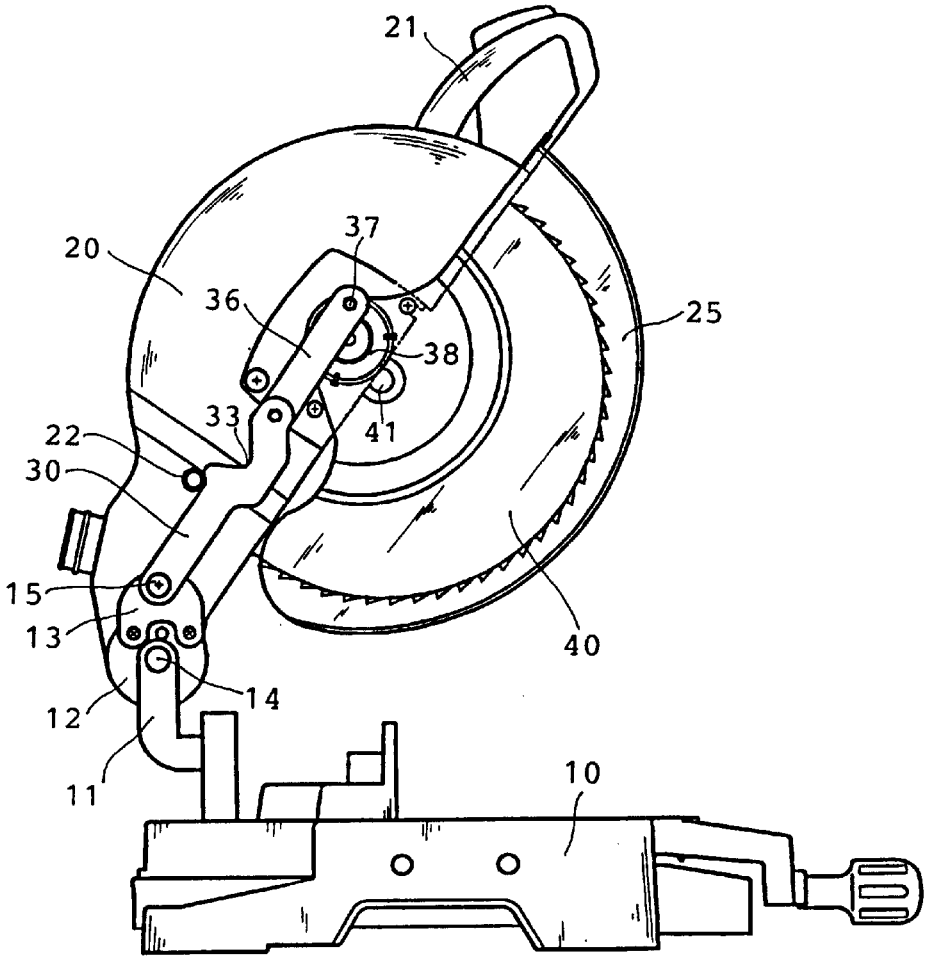
FIG. 2 is a side plan view of a blade guard device for a circular sawing machine in accordance with the present invention.
Figure 3:
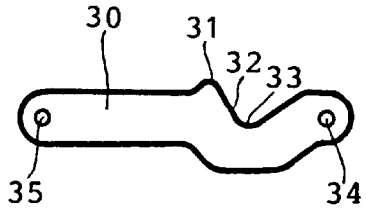
FIG. 3 is a side plan view of a pressing lever of the blade guard device as shown in FIG. 2.

Referring to the drawings and initially to FIGS. 2 and 3, a blade guard device for a circular sawing machine in accordance with the present invention comprises a support frame 11 secured on a turntable 10, a stationary base 12 secured to the support frame 11, a locating plate 13 secured to the stationary base 12, a semi-circular upper guard 20 having a lower end pivotally mounted on the stationary base 12 about a pivot shaft 14, and an upper end including a handle 21, a circular saw 40 rotatably mounted on the upper guard 20, an elongated pressing lever 30 having a first end pivotally mounted on the locating plate 13 by a pivot shaft 15 extending through an axial hole 35 defined in the first end of the pressing lever 30, a mediate portion having a curved operation surface, and a second end, a pressing roller 22 secured on the upper guard 20 to move therewith and slidably engaging the curved operation surface of the mediate portion of the pressing lever 30, a link 36 having a first end secured to the second end of the pressing lever 30 to move therewith, a circular mounting plate 38 secured to a second end of the link 36 to move therewith and rotatably mounted on the upper guard 20, and a sector shaped transparent lower guard 25 secured to the circular mounting plate 38 to rotate therewith for covering the circular saw 40.

The blade guard device comprises a bolt 39 extending through an axial hole 34 defined in the second end of the pressing lever 30 and through the first end of the link 3 6 for securing the first end of the link 36 to the second end of the pressing lever 30, and a bolt 37 extending through the second end of the link 36 and through the circular mounting plate 38 for securing the second end of the link 36 to the circular mounting plate 38.

The circular saw 40 includes a central rotation shaft 41 driven by a motor (not shown) for rotating the circular saw 40 to perform a cutting action. The circular mounting plate 38 includes a torsion spring or coil spring (not shown) fitted therein for providing a restoring force on the lower guard 25 to force the lower guard 25 to cover the circular saw 40 when the circular sawing machine is not operated.

As shown in FIG. 3, the curved operation surface of the mediate portion of the pressing lever 30 includes a projection 31 extending outward and located proximate to the first end of the pressing lever 30, an inclined section 32 extending inward from the projection 31, and a lower bent section 33 extending from the inclined section 32 and located proximate to the second end of the pressing lever 30.

Figure 4:
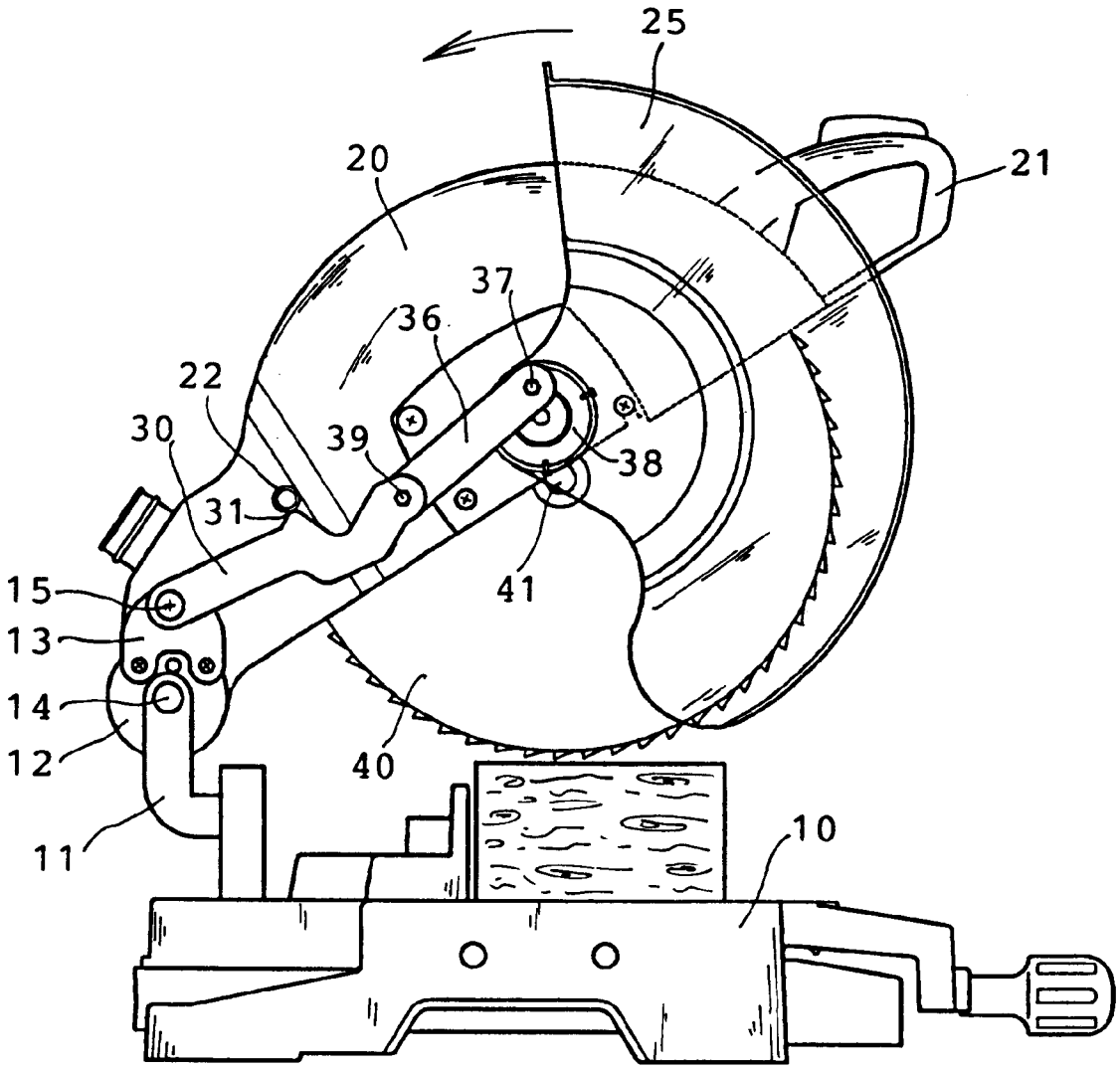
FIG. 4 is an operational view of the blade guard device as shown in FIG. 2 in use.
Figure 5:
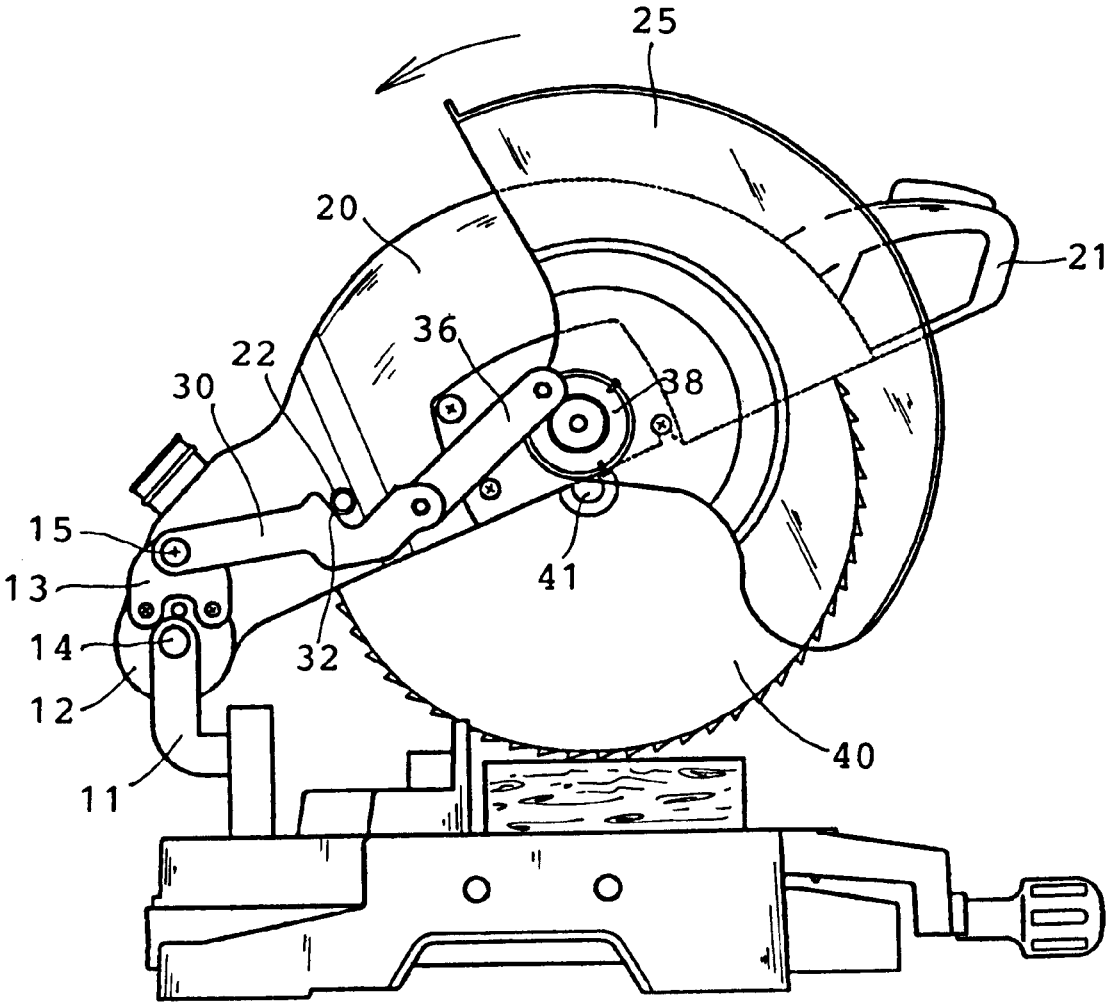
FIG. 5 is an operational view of the blade guard device as shown in FIG. 4 in use.
Figure 6:
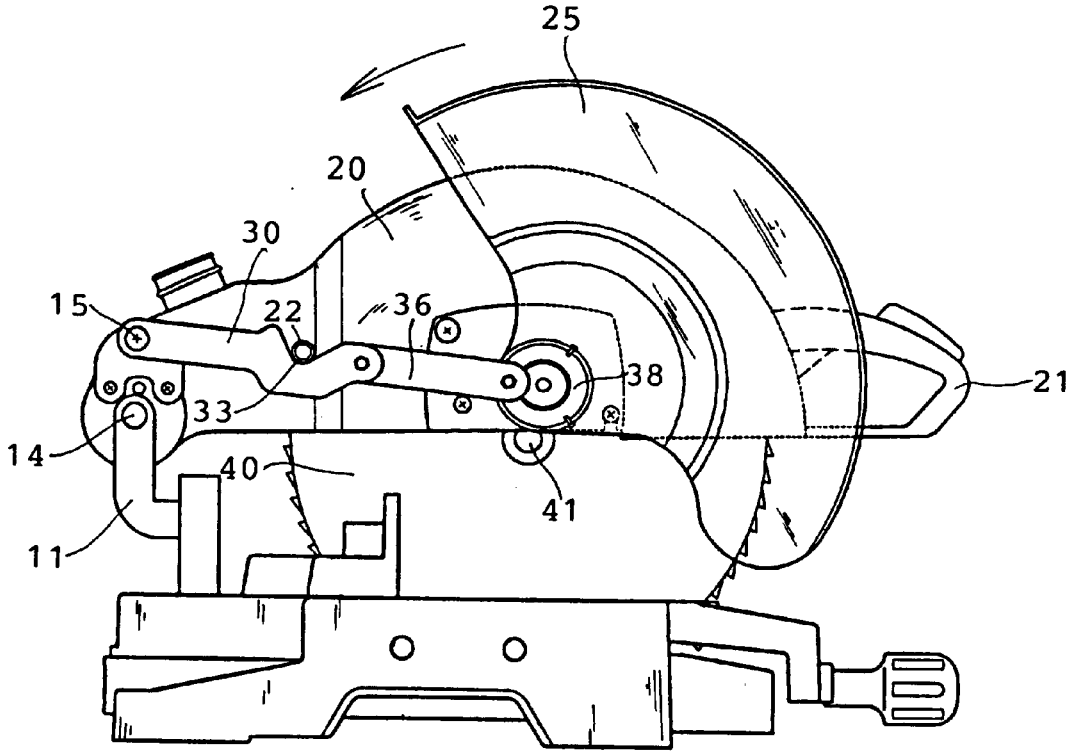
FIG. 6 is an operational view of the blade guard device as shown in FIG. 5 in use.

In operation, referring to FIGS. 4–6 with reference to FIGS. 2 and 3, when the circular sawing machine is not operated, the roller 22 is initially located beside the projection 31 of the curved operation surface of the mediate portion of the pressing lever 30 as shown in FIG. 2. In such a situation, the lower guard 25 fully encompasses the circular saw 40, thereby preventing the circular saw 40 from exposing to the environment so as to protect a user.

When the handle 21 is moved downward, the upper guard 20 is pivoted downward to move the pressing roller 22 which is initially moved from the position as shown in FIG. 2 to the position as shown in FIG. 4 so as to press downward the top of the projection 31 of the curved operation surface of the mediate portion of the pressing lever 30, thereby moving the link 36 which largely pulls the circular mounting plate 38 for rapidly rotating the circular mounting plate 38 which rapidly rotates the lower guard 25 upward, thereby rapidly exposing a lower part of the circular saw 40 as shown in FIG. 4, thereby facilitating a user efficiently cutting a thicker workpiece.

When the handle 21 is further moved downward, the pressing roller 22 is further moved from the position as shown in FIG. 4 to the position as shown in FIG. 5 so as to press the inclined section 32 of the curved operation surface of the mediate portion of the pressing lever 30, thereby further moving the link 36 which slightly pulls the circular mounting plate 38 for gradually rotating the circular mounting plate 38 which slowly rotates the lower guard 25 upward, thereby slowly exposing the lower part of the circular saw 40 as shown in FIG. 5.

When the handle 21 is further moved downward, the pressing roller 22 is further moved from the position as shown in FIG. 5 to the position as shown in FIG. 6 so as to press the lower bent section 32 of the curved operation surface of the mediate portion of the pressing lever 30, thereby further moving the link 36 which slightly pulls the circular mounting plate 38 for gradually rotating the circular mounting plate 38 which slowly rotates the lower guard 25 upward, thereby slowly exposing the lower part of the circular saw 40 as shown in FIG. 6.

Accordingly, the lower guard 25 can be lifted rapidly by the pressing roller 22 pressing the top of the projection 31 of the curved operation surface of the mediate portion of the pressing lever 30, thereby rapidly exposing a lower part of the circular saw 40 for facilitating a user efficiently cutting a thicker workpiece. In addition, the pressing lever 30 co-operates with the link 36 for rotating and lifting the lower guard 25 without having to additionally provide a slot as is disclosed in the Terpstra's U.S. Pat. No. 5,203,245 so that the blade guard device of the present invention has great stiffness and rigidity.

It should be clear to those skilled in the art that further embodiments may be made without departing from the scope of the present invention.

What is claimed is:

1. A blade guard device for a circular sawing machine comprising:

a support frame (11);

a stationary base (12) secured to said support frame (11);

a locating plate (13) secured to said stationary base (12);

an upper guard (20) having a lower end pivotally mounted on said stationary base (12) and an upper end including a handle (21);

a circular saw (40) rotatably mounted on said upper guard (20);

an elongated pressing lever (30) having a first end, a mediate portion and a second end, said first end of said pressing lever (30) pivotally mounted on said locating plate (13), said mediate portion of said pressing lever (30) having a curved operation surface including a projection (31) extending outward and located proximate to said first end of said pressing lever (30), an inclined section (32) extending inward from said projection (31), and a lower bent section (33) extending from said inclined section (32) and located proximate to said second end of said pressing lever (30);

a pressing roller (22) secured on said upper guard (20) to move therewith, and slidably engaging said curved operation surface of said mediate portion of said pressing lever (30);

a link (36) having a first end secured to said second end of said pressing lever (30) to move therewith;

a bolt (39) extending through said second end of said pressing lever (30) and through said first end of said link (36) for securing said first end of said link (36) to said second end of said pressing lever (30);

a circular mounting plate (38) secured to a second end of said link (36) to move therewith and rotatably mounted on said upper guard (20); and a lower guard (25) secured to said circular mounting plate (38) to rotate therewith for covering said circular saw (40);

whereby, when said handle (21) is moved downward, said upper guard (20) is pivoted downward to move said pressing roller (22) which is initially moved to press said projection (31) of said curved operation surface of said mediate portion of said pressing lever (30), thereby moving said link (36) which largely pulls said circular mounting plate (38) for rapidly rotating said circular mounting plate (38) which rapidly rotates said lower guard (25) upward, thereby rapidly exposing a lower part of said circular saw (40);

whereby, when said handle (21) is further moved downward, said pressing roller (22) is further moved to press said inclined section (32) of said curved operation surface of said mediate portion of said pressing lever (30), thereby further moving said link (36) which slightly pulls said circular mounting plate (38) for gradually rotating said circular mounting plate (38) which slowly rotates said lower guard (25) upward, thereby slowly exposing said lower part of said circular saw (40); and whereby, when said handle (21) is further moved downward, said pressing roller (22) is further moved to press said lower bent section (32) of said curved operation surface of said mediate portion of said pressing lever (30), thereby further moving said link (36) which slightly pulls said circular mounting plate (38) for gradually rotating said circular mounting plate (38) which slowly rotates said lower guard (25) upward, thereby slowly exposing said lower part of said circular saw (40).

2. The blade guard device in accordance with claim 1, further comprising a bolt (37) extending through said second end of said link (36) and through said circular mounting plate (38) for securing said second end of said link (36) to said circular mounting plate (38).

* * * * *